US010047998B2

(12) United States Patent
McGarry

(10) Patent No.: US 10,047,998 B2
(45) Date of Patent: Aug. 14, 2018

(54) COOLER CHEST INTERIOR INSULATION DEVICE AND METHOD

(71) Applicant: Vern McGarry, Ladera Ranch, CA (US)

(72) Inventor: Vern McGarry, Ladera Ranch, CA (US)

( * ) Notice: Subject to any disclaimer, the term of this patent is extended or adjusted under 35 U.S.C. 154(b) by 0 days.

(21) Appl. No.: 15/853,766

(22) Filed: Dec. 23, 2017

(65) Prior Publication Data

US 2018/0120013 A1 May 3, 2018

Related U.S. Application Data

(63) Continuation-in-part of application No. 14/539,216, filed on Dec. 29, 2014.

(51) Int. Cl.
*F25D 3/08* (2006.01)
*A45C 11/20* (2006.01)

(52) U.S. Cl.
CPC ..... *F25D 3/08* (2013.01); *A45C 11/20* (2013.01); *F25D 2201/126* (2013.01); *F25D 2303/081* (2013.01); *F25D 2331/804* (2013.01)

(58) Field of Classification Search
CPC ..... F25D 3/08; F25D 2303/081; F25D 2331/804; F25D 2201/126; F25D 3/06; F25D 2600/04; A45C 11/20
USPC ..... 62/457.2; 220/23.86
See application file for complete search history.

(56) References Cited

U.S. PATENT DOCUMENTS

| | | | |
|---|---|---|---|
| 2,631,439 | A | 3/1953 | Feigenbaum |
| 4,037,648 | A | 7/1977 | Maitra |
| 4,162,029 | A | 7/1979 | Gottsegen |
| 4,324,111 | A | 4/1982 | Edwards |
| 4,675,225 | A | 6/1987 | Cutler |
| 4,724,681 | A | 2/1988 | Bartholomew |
| 4,759,467 | A | 7/1988 | Byrne |
| 4,775,072 | A | 10/1988 | Lundblade |
| 4,972,529 | A | 11/1990 | Wolfson, Jr. |
| 5,022,101 | A | 6/1991 | Gosselin |
| 5,052,184 | A | 10/1991 | Jarvis |
| 5,052,185 | A | 10/1991 | Spahr |
| 5,095,718 | A | 3/1992 | Ormond |
| 5,105,970 | A | 4/1992 | Malone |
| 5,154,309 | A | 10/1992 | Wischusen |
| 5,351,494 | A | 10/1994 | Jensen |
| 5,493,874 | A | 2/1996 | Landgrebe |

(Continued)

*Primary Examiner* — Mohammad M Ali
(74) *Attorney, Agent, or Firm* — Jafari Law Group, Inc.

(57) ABSTRACT

The invention involves an insulation device comprising of a pad defined by a length and a width suitable for fitting snuggly within a cavity of a cooler. In exemplary embodiments, the pad comprises a closed-cell polyvinyl chloride nitrile butadiene rubber foam, also known as PVC/NBR, the pad defined by dimensions including a certain thickness such that the pad may be compressed against the interior walls of the cooler cavity without collapsing or folding over. The edges of the pad may be pressed against the interior walls of the cooler cavity to form a compression seal throughout the perimetrical edge of the pad against the interior walls of the cooler cavity; the compression-sealed edge prolongs a period during which low temperatures may be maintained. The pad is preferably water resistant, lightweight, washable, sufficiently flexible and can be easily trimmed or cut to a desired size.

20 Claims, 5 Drawing Sheets

(56) References Cited

U.S. PATENT DOCUMENTS

| | | | | |
|---|---|---|---|---|
| 5,860,281 | A * | 1/1999 | Coffee | A45C 11/20 312/298 |
| 5,901,571 | A * | 5/1999 | Whaley | F25D 3/08 62/457.5 |
| 6,003,719 | A | 12/1999 | Stewart | |
| 6,027,249 | A | 2/2000 | Bielinski | |
| 6,247,328 | B1 * | 6/2001 | Mogil | A45C 7/0077 383/110 |
| 6,637,615 | B2 * | 10/2003 | Kawasumi | F25D 23/063 220/4.02 |
| 7,415,794 | B1 * | 8/2008 | Thompson | A01K 97/22 206/315.11 |
| 7,730,739 | B2 | 6/2010 | Fuchs | |
| 2003/0167789 | A1 * | 9/2003 | Tanimoto | B65D 81/18 62/457.7 |
| 2005/0061021 | A1 * | 3/2005 | Uihlein | F25D 23/021 62/441 |
| 2005/0103044 | A1 * | 5/2005 | Mogil | A45C 11/20 62/457.7 |
| 2005/0109776 | A1 * | 5/2005 | Camp, Jr. | A45C 11/20 220/23.86 |
| 2006/0169691 | A1 * | 8/2006 | Rothschild | A45C 7/0036 220/7 |
| 2012/0018102 | A1 * | 1/2012 | Ungs | E06B 9/13 160/113 |
| 2012/0069866 | A1 * | 3/2012 | Derevyagin | G01N 21/81 374/28 |
| 2012/0135221 | A1 | 5/2012 | Weidinger | |
| 2013/0335364 | A1 * | 12/2013 | Tseng | G06F 1/16 345/174 |

* cited by examiner

COOLER CHEST INTERIOR INSULATION DEVICE AND METHOD

PRIORITY NOTICE

The present application claims priority under 35 U.S.C. § 120 to, and is a continuation-in-part application of, U.S. Non-provisional patent application Ser. No. 14/539,216 filed on Dec. 29, 2014, the disclosure of which is incorporated herein by reference in its entirety.

TECHNICAL FIELD OF THE INVENTION

The present invention relates generally to a cooler chest interior insulation device and method for insulation of items stored therein using the same. More specifically, the present invention relates to a flexible pad of insulation material that may be placed in a portable cooler cavity in a manner such as to create a compression-sealed edge for improving the insulation of perishables and the effectiveness of the cooling medium placed inside the cooler.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Insulation devices for storage containers such as coolers are well known in the art. In fact, the prior art is busy with different teachings for a wide variety of insulation devices, which range from complex containers with refrigerated cavities and insulating walls forming various compartments, to simpler insulating jackets that cover the exterior of refrigerated containers. Nevertheless, the prior art is riddled with inadequacies insofar as prolonging insulation of items such as perishables without the need for power-driven climate control devices, or otherwise efficient, inexpensive means of improving the insulation of perishables and the effectiveness of the cooling medium placed inside a cooler cavity.

For example, some devices attempt to insulate items stored in a cooler cavity by providing an additional layer of insulation on the exterior of the cooler containing the cooler cavity; these so-called cooler jackets however ultimately depend on the effectiveness of the cooler itself, and typically do little to prevent undesired heating. Other devices implement pockets of insulating material that may be filled with ice or other frozen materials; however, such devices do not tackle the problem posed by air circulating within the cooler cavity, which generally introduces heat to the stored items via convection and conduction. Similarly, devices that implement several layers of some insulating material around the cooler cavity or even beneath the cooler cavity fail to address the air within the cooler cavity itself, which itself reduces the insulating properties of the cooling container.

Although some devices have tackled the problem of minimizing air that may be circulating within a cooler cavity, such devices do so inadequately; such inadequacies range from the types of materials implemented, to the construction of the devices that fail to provide an adequate seal in order to minimize heat convection or heat conduction.

Therefore, there exists a previously unappreciated need for a new and improved method for insulating items stored in a cooler cavity using a device that: prevents undesired heating from air circulating within the cooler cavity; adequately seals items within the cooler cavity to minimize air circulating within an unused portion of the cooler cavity; and is efficient to manufacture and readily available to a consumer.

It is to these ends that the present invention has been developed.

SUMMARY OF THE INVENTION

To minimize the limitations in the prior art, and to minimize other limitations that will be apparent upon reading and understanding the present specification, the present invention describes a flexible pad of insulation material that may be placed in a portable cooler cavity in a manner such as to create a compression-sealed edge for improving the insulation of perishables and the effectiveness of the cooling medium placed inside the cooler.

Generally, the invention involves an insulation device comprising of a pad defined by a length and a width suitable for fitting snuggly within the cavity of a cooler. Moreover, the pad is generally of a certain material and certain thickness such that the pad may be compressed against the interior walls of a cooler cavity without collapsing, bowing or folding over. The edges of the pad may be pressed against the interior walls of the cooler cavity to form a compression seal throughout the perimetrical edge of the pad against the interior walls of the cooler cavity; the compression-sealed edge prolongs a period during which low temperatures may be maintained. In exemplary embodiments, the material for the pad comprises a closed-cell polyvinyl chloride nitrile butadiene rubber foam, also known as PVC/NBR. In exemplary embodiments, the pad may be readily cut or otherwise trimmed to a desired dimension. Typically, the pad is preferably water resistant and may be washed.

A cooler chest configured for improved insulation of perishables and cooling medium, in accordance with an exemplary embodiment of the present invention, comprises: a cover; an interior cavity formed by interior walls, the interior cavity having an interior depth, length and width; and a flexible insulating pad laying substantially planar along a surface of the interior cavity of the cooler chest, comprising: a rectangular prism having a thickness sufficient to allow compression without bowing the flexible insulating pad, the rectangular prism having a length and a width slightly greater than a length and a width of the interior cavity of the cooler chest, and an edge along a perimeter of the rectangular prism that is pressed against the interior walls of the cooler chest so that the flexible insulating pad does not bow along the entire surface of the interior cavity and the edge conforms to the interior walls forming a compression seal comprising: a first bulge along a top surface of the edge of the flexible insulating pad, and a second bulge along a bottom surface of the edge of the flexible insulating pad.

A method of insulating a portion of a cooler chest packed with perishables and cooling medium, in accordance with practice of an exemplary embodiment of the present invention, comprises: cutting a single sheet of a closed cell polyvinyl chloride nitrile butadiene rubber (PVC/NBR) foam to form a pad, the pad comprising a thickness sufficient to allow compression without bowing the pad when pressed against interior walls of the cooler chest, the pad defined by a length and a width slightly greater than a length and a width of an interior cavity formed by the interior walls of the cooler chest; placing the pad over the interior cavity and below a cover of the cooler chest to conceal the perishables and cooling medium; and sealing the interior cavity of the cooler chest with a compression seal, including: pressing an edge along a perimeter of the pad against the interior walls of the cooler chest so that the edge conforms to the interior walls of the cooler chest, wherein the pad remains substantially planar along an entire surface of the interior cavity of the cooler chest and the pad does not bow, and forming a bulge on a top surface and a bottom surface of each edge of the pad pressed against the interior walls.

A cooler chest configured for improved insulation of perishables and cooling medium, in accordance with another exemplary embodiment of the present invention, comprises: an interior cavity formed by interior walls, the interior cavity having an interior depth, length and width; and a flexible insulating pad laying substantially planar along a surface of the interior cavity of the cooler chest, comprising: a rectangular closed cell polyvinyl chloride nitrile butadiene rubber (PVC/NBR) foam having: a thickness sufficient to allow compression without bowing the flexible insulating pad, and a length and a width slightly greater than a length and a width of the interior cavity of the cooler chest, and an edge along a perimeter of the flexible insulating pad that is pressed against the interior walls of the cooler chest so that the flexible insulating pad does not bow along the entire surface of the interior cavity and the edge conforms to the interior walls forming a compression seal comprising: a first bulge along a top surface of the edge of the flexible insulating pad, and a second bulge along a bottom surface of the edge of the flexible insulating pad, wherein the dimensions of the flexible insulating pad comprises include: a thickness of 0.75 inches; a length between 20 to 45 inches; and a width between 10 and 20 inches.

Accordingly, it is the principle objective of the invention to improve on the insulation characteristics of a conventional portable cooler.

It is an objective of the present invention to minimize a volume of an interior cooler cavity, leaving minimal air around the contents therein.

It is another objective of the present invention to prevent undesired heating from air circulating within the cooler cavity.

It is another objective of the present invention to provide an insulating device that adequately seals items within the cooler cavity to minimize air circulating within the used portion of the cooler cavity.

It is yet another objective of the present invention to provide an insulating device that is efficient to manufacture and readily available to a consumer.

These advantages and features of the present invention are not meant as limiting objectives, but are described herein with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of the various embodiments of the invention. Furthermore, elements that are known to be common and well understood to those in the industry are not depicted in order to provide a clear view of the various embodiments of the invention. The drawings that accompany the detailed description can be briefly described as follows.

DETAILED DESCRIPTION OF THE INVENTION

Figure 1:
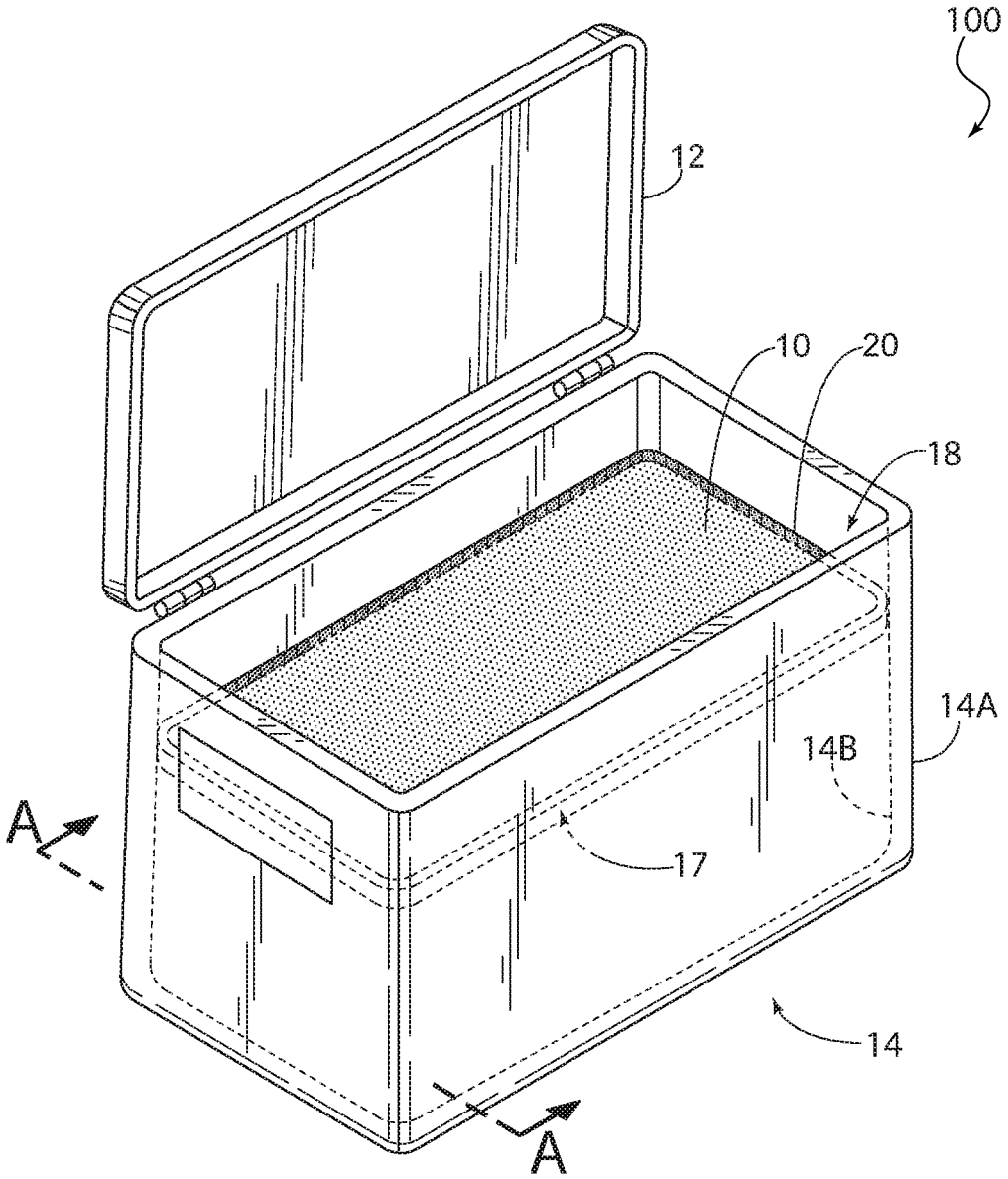
FIG. 1 illustrates a perspective view of a cooler chest interior insulation system in accordance with an exemplary embodiment of the present invention.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized, and changes may be made without departing from the scope of the invention. Wherever possible, the same reference numbers are used in the drawings and the following description to refer to the same or similar elements.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and or steps. Thus, such conditional language is not generally intended to imply that features, elements and or steps are in any way required for one or more embodiments, whether these features, elements and or steps are included or are to be performed in any particular embodiment.

The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present. The term "and or" means that "and" applies to some embodiments and "or" applies to some embodiments. Thus, A, B, and or C can be replaced with A, B, and C written in one sentence and A, B, or C written in another sentence. A, B, and or C means that some embodiments can include A and B, some embodiments can include A and C, some embodiments can include B and C, some embodiments can only include A, some embodiments can include only B, some embodiments can include only C, and some embodiments include A, B, and C. The term "and or" is used to avoid unnecessary redundancy.

While exemplary embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the invention or inventions disclosed herein. Accordingly, the following detailed description does not limit the disclosure. Instead, the proper scope of the disclosure is defined by the appended claims.

Turning now to the figures, FIG. 1 illustrates a perspective view of a cooler chest interior insulation system in accordance with an exemplary embodiment of the present invention. More specifically, FIG. 1 depicts cooler interior insulation system 100, comprising: a cooler chest 14 including a cover 12 and an interior cavity 18, wherein items such as perishables 22 may be stored along with or within a cooling medium 16 within the interior cavity 18; and a cooler chest interior insulation device (or insulating pad 10) placed over the interior cavity and below cover 12 of the cooler chest 14 to conceal the perishables 22 and cooling medium 16 (see also FIG. 3).

Cooler chest 14 may be any type of cooler chest without deviating from the scope of the present invention, including any type of insulating box or closed structure having an interior cavity suitable for keeping food or drink items cool. Cooler chest 14 may be any known cooler, portable ice chest, ice box, cool box, chilly bin, or esky typically including a lid such as cover 12. Without limiting the scope of the present invention, cooler chest 14 may be formed with exterior and interior shells of plastic including an insulating material 15 in-between (i.e. see for example in FIG. 3 insulating material 15 between outer wall 14A and inner wall 14B); in exemplary embodiments, the insulating material may be an insulating foam. In some embodiments, cooler chest 14 may be constructed of a single material such as foam. Although typically cooler chest 14 is a simple cooler, other more complex coolers may be implemented into system 100 without deviating from the scope of the present invention, including using thermoelectric coolers and the like. Some cooler chests compatible with the present invention may include a cover that is removably coupled to the cooler body, including for example by means of a cover hinge 12A (see FIG. 3). No matter the type of cooler chest 14, an internal cavity 18 within the cooler provides an insulated chamber intended to hold and insulate contents such as perishables 22 and cooling medium 16.

Cooling medium 16 may be any type of medium suitable for cooling or keeping items cool within interior cavity 18. For example, and without limiting the scope of the present invention, cooling medium 16 may include ice in any form such as crushed ice, cubed ice or a block of ice, or packaged commercial products intended to go through a freezing and melting cycle with each use such as gel packs with refrigerant gels, ice blankets including flexible liquid-filled cells, for wrapping around perishables 22.

Perishables 22 may be any item including food items, drinking products or medical products that may be desirably preserved at cooler temperatures. As such, perishables 22 may be variable in nature, having different sizes, shapes, weights, packaging, and other characteristics. Perishables 22 are generally placed in an organized fashion within the interior cavity 18 and wrapped around or otherwise placed in contact with cooling medium 16. Because it is frequently the case that the interior cavity 18 is only partly filled and a significant portion of a volume of interior cavity 18 is unused, the air circulating in this unused portion naturally introduces heat to the contents by convection and conduction. As such, a system in accordance with the present invention—such as the system 100 shown—implements an insulating device such as insulating pad 10 for improving the insulation of perishables 22 and the effectiveness of cooling medium 16 placed inside cooler chest 14.

Insulating pad 10 may comprise a single sheet of insulating material that may be placed within interior cavity 18 of cooler chest 14. Insulating pad 10 is slightly oversized in width and length compared to the width and length of interior cavity 18 of cooler chest 14. This slight oversizing of insulating pad 10 facilitates the edges of insulating pad 10 to be pressed up against interior walls 14B of the cooler cavity 18 so as to create a compression-sealed edge (compression seal 20) along a perimetrical edge or boundary 17 between insulating pad 10 and interior walls 14B within interior cavity 18 of cooler chest 14. Compression seal 20 (shaded in FIG. 1 and discussed further below) typically forms slight bulges 20A and 20B (see for example FIG. 5) along boundary 17 as insulating pad 10 conforms to interior walls 14B of the cooler cavity 18, thus sealing the lower portion 18A of the cooler cavity 18 from the now upper portion 18B of the cooler cavity 18 (see also FIG. 3). Because the lower portion 18A is separated from the upper portion 18B, which does not include cooling medium 16, perishables 22 are kept cool for a much longer period as the air circulating in upper portion 18B is obstructed from introducing heat by convection and conduction to the contents in lower portion 18A. The following figure shows an exemplary embodiment of insulating pad 10.

Figure 2:
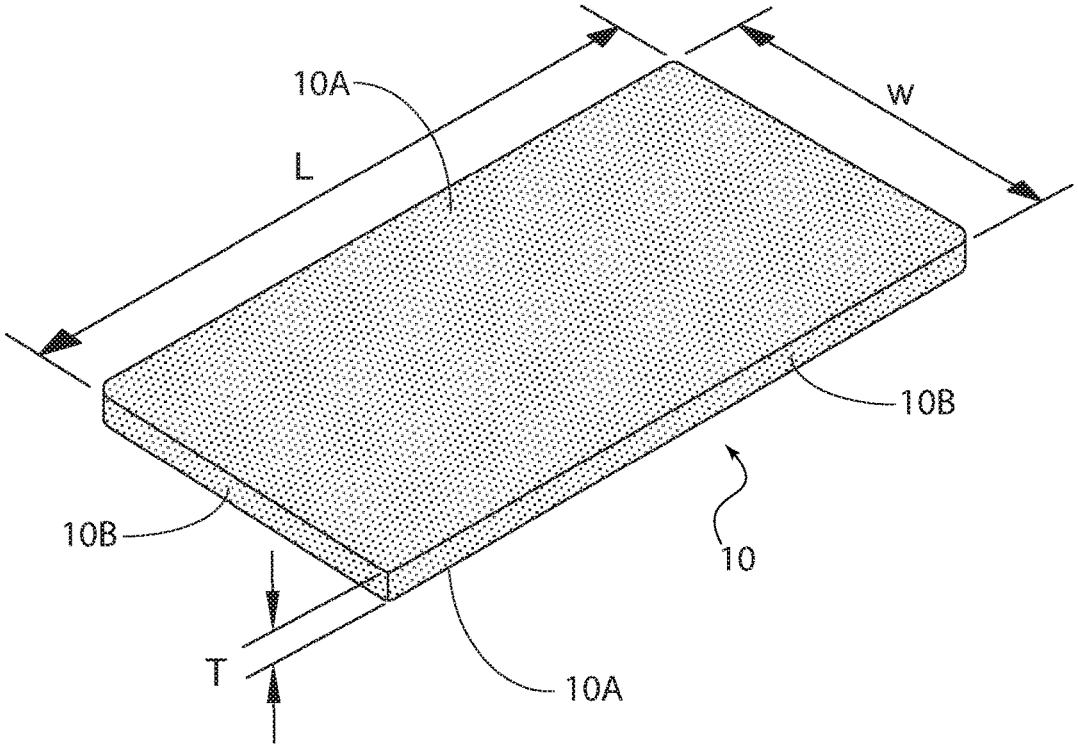
FIG. 2 illustrates a perspective view of a cooler chest interior insulation device in accordance with an exemplary embodiment of the present invention.

Turning now to the next figure, FIG. 2 illustrates a perspective view of a cooler chest interior insulation device in accordance with an exemplary embodiment of the present invention. More specifically, FIG. 2 depicts insulating pad 10, which may be defined by a single flexible insulating sheet having substantially planar surfaces 10A as well as planar edge walls 10B.

In exemplary embodiments, insulating pad 10 comprises a rectangular prism, which includes a thickness T sufficient to allow compression without bowing insulating pad 10. In exemplary embodiments, the rectangular prism has a length L and a width W slightly greater than a length and a width of interior cavity 18 of cooler chest 14. Of course, other shapes of insulating pad 10 may be possible without deviating from the scope of the present invention; one benefit of the rectangular prism shape is the ease with which the perimetrical edge of insulating pad 10 may be pressed against interior walls 18 of cooler chest 14, as will be discussed further below.

In exemplary embodiments, insulating pad 10 is constructed of an insulating material such as a closed cell polyvinyl chloride nitrile butadiene rubber (PVC/NBR) foam. A PVC/NBR foam may be desirable because it is rigid and sturdy enough to maintain a planar shape while allowing extremities of insulating pad 10 (for example a perimetrical edge of the pad) to be compressed significantly against interior walls 18 meaning a top surface of insulating pad 10 is able to remain substantially flat while its perimetrical edge is pressed against the interior walls of the cooler's cavity—thereby creating compression seal 20. Moreover, in exemplary embodiments, the PVC/NBR foam has a 4.0-7.0 lb./ft$^3$ (64-112 kg/m$^3$) density. In other exemplary embodiments, similar materials such as other vinyl/nitrile blends or vinyl/nitrile/neoprene blends (also known as PVC/NBR/CR) foams may be used without deviating from the scope of the present invention. Accordingly, other materials and dimensions may be possible, however, materials that are easily bendable or foldable cannot be pressed against the interior walls of a cooler chest without causing insulating pad 10 to collapse or fold onto itself. As such, whatever material used to form insulating pad 10, as mentioned above, the material should be rigid and sturdy enough to maintain a planar shape while allowing extremities of insulating pad 10 to be compressed significantly against interior walls 18. Notably, from this view in which insulating pad 10 is situated outside of cooler chest 14, insulating pad 10 includes no compressed edges as the material is free to expand without the pressure of being pressed against the interior walls of interior cavity 18.

In one exemplary embodiments, insulating pad 10 may have a length L of approximately 35 to 45 inches, a width W of approximately 15 to 20 inches, and a thickness T of approximately 0.75 to 1 inch. In other exemplary embodiments, insulating pad 10 may have a length L of approximately 20 to 30 inches, a width W of approximately 10 to 15 inches, and a thickness T of approximately 0.75 to 1 inch.

In one preferred embodiment, insulating pad 10 is a relatively large insulating pad comprising a length L of 40.5 inches long, a width W of 17.5 inches wide, and a thickness T of 0.75 inches thick; such insulating pad 10 may be suitable for most coolers in the 75-quart capacity, up to about 180-quarts. In another preferred embodiment, insulating pad 10 is a relatively small insulating pad 10 comprising a length L of 24.5 inches long, a width W of 13.5 inches wide, and a thickness T of 0.75 inches thick; such insulating pad 10 may be suitable for smaller coolers.

These dimensions for an insulating pad 10 with generally a rectangular prism shape have been tested and proven to significantly extend a cooling medium's life expand by as much as 30%. The following is a chart illustrating the effectiveness of such embodiments of the present invention:

TABLE 1.0

| | 9.0 lbs. Ice | 9.0 lbs. Ice with Insulating Pad | 20.0 lbs. Ice | 20.0 lbs. Ice with Insulating Pad |
|---|---|---|---|---|
| HOURS | 31 | 45 | 58.5 | 84 |
| Crushed Ice Life: Extended-hours | | 14 Hours | | 25.5 Hours |
| Crushed Ice Life: Extended-% | | 28.70% | | 30.40% |

As may be gleaned from Table 1.0 above, testing an insulating pad in accordance with an exemplary embodiment of the present invention placed within a 44-quart cooler, yielded the extended life for a cooling medium comprising crushed ice within the cooler. Without deviating from the scope the present invention, and merely for illustrative purposes, for each test above, twelve canned sodas from a refrigerator were placed into said cooler. On top and around the sodas the listed amounts of crushed ice were placed. After about 24-hours into each test, the melting process of the cooling medium was tested every few hours, to simulate the opening and closing of an ice chest during regular use—such as during a camping or travel trip. Using 9 pounds of ice, an exemplary insulating pad extended the ice life by almost 29 percent. Using 20 pounds of ice, the exemplary insulating pad extended the ice life by just over 30 percent. In the latter case, the lifetime of the crushed ice was expanded by over an entire day; this is due in part because of the effectiveness of the compression seal 20 formed along a perimetrical edge 17 whenever insulating pad is properly placed within interior cavity 18 of cooler chest 14. The next figure better illustrates a suitable placement and positioning of an insulating pad within a cooler chest cavity, in accordance with exemplary practice of the present invention.

Figure 3:
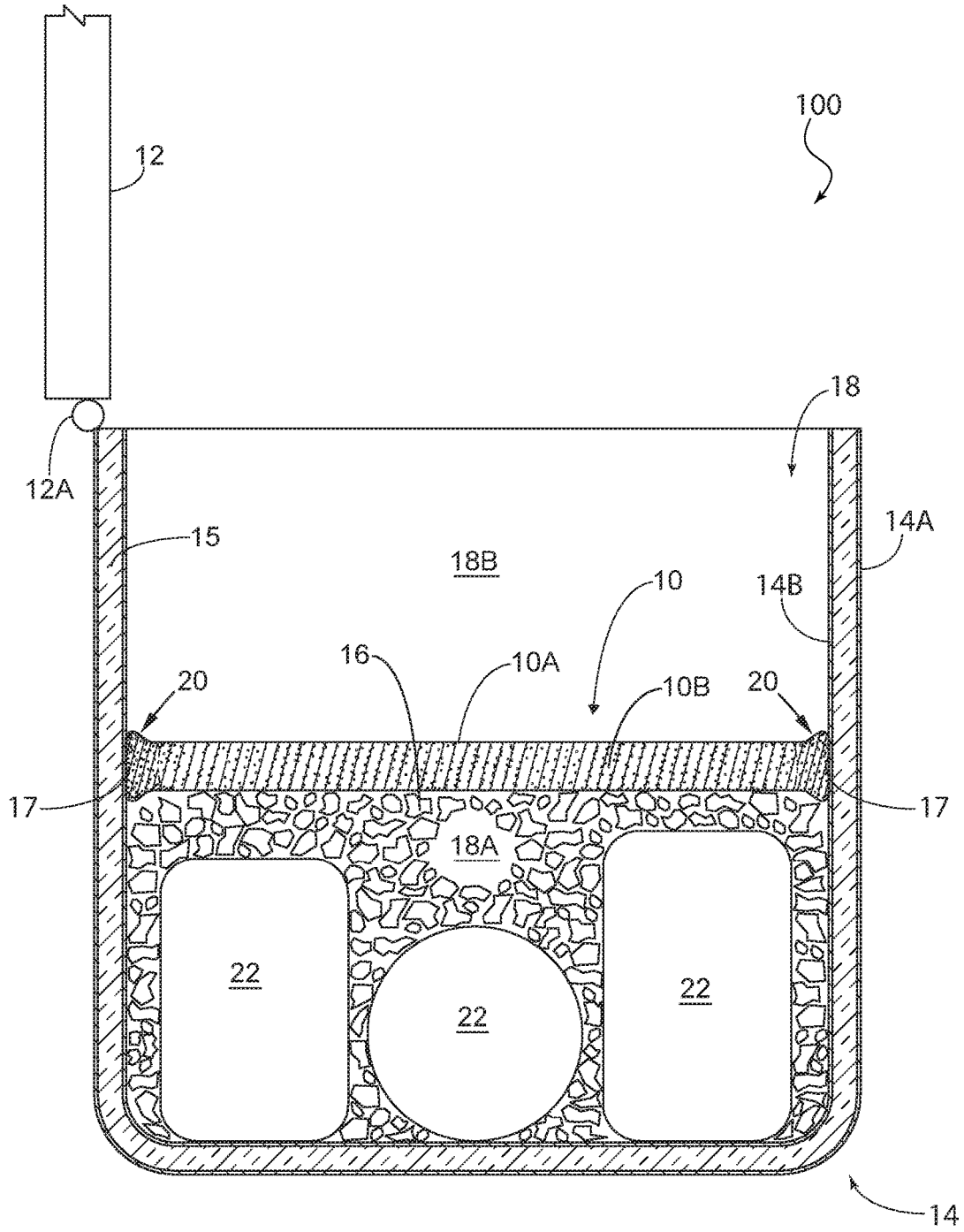
FIG. 3 illustrates a cross-sectional, side view of a cooler chest interior insulation system in accordance with an exemplary embodiment of the present invention.
Figure 4:
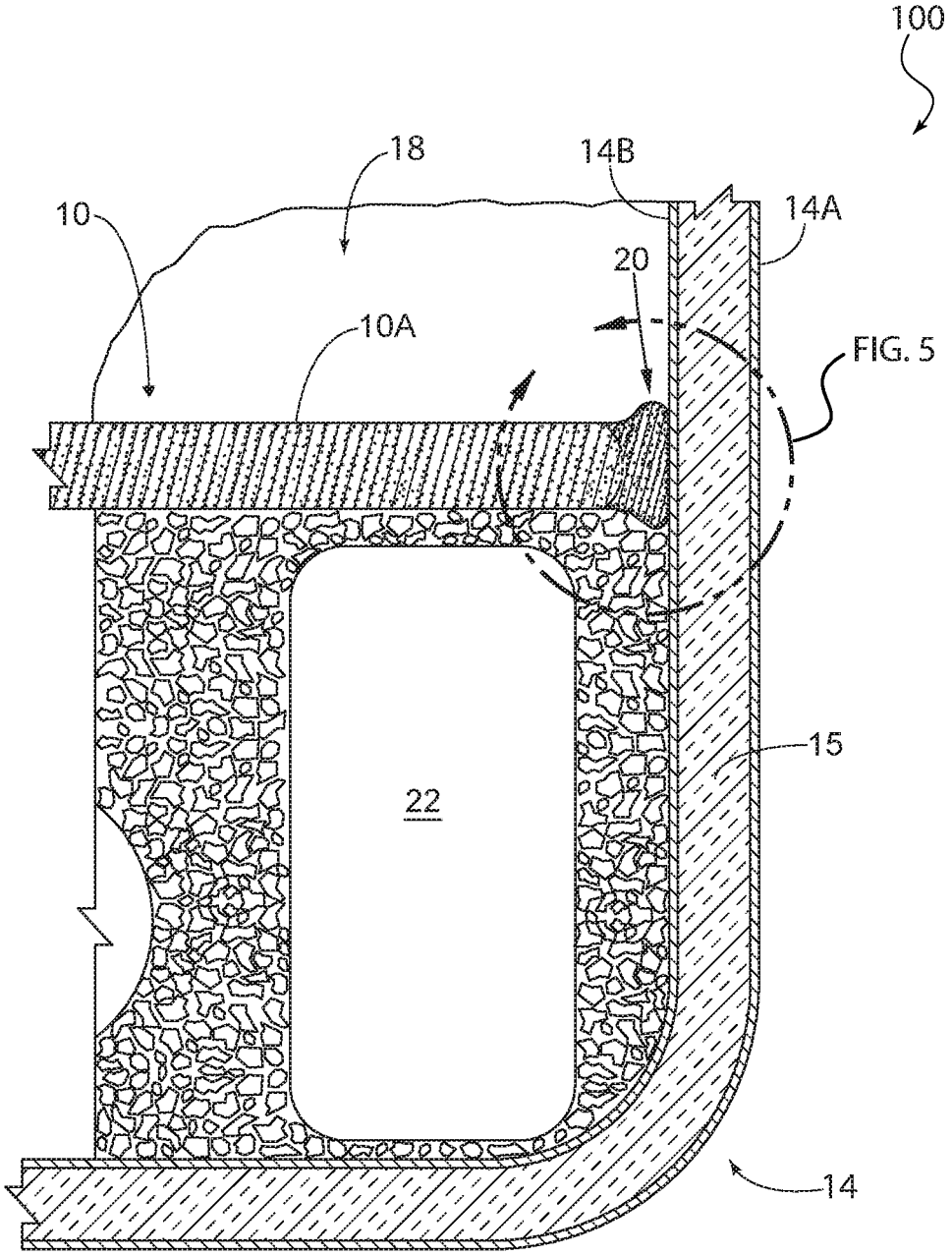
FIG. 4 illustrates a close-up view of FIG. 3 depicting a compression seal formed throughout a perimetrical boundary between the cooler interior insulation device and interior wall of the cooler.

Turning now to the next two figures, FIG. 3 illustrates a cross-sectional side view of a cooler chest interior insulation system in accordance with an exemplary embodiment of the present invention, and FIG. 4 illustrates a close-up view of FIG. 3 depicting a compression seal formed throughout a perimetrical boundary between the cooler interior insulation device and interior wall of the cooler. More specifically, a cross-sectional side view of system 100 is shown, comprising: cooler chest 14 partially packed with perishables 22 and a cooling medium 16. Within the interior cavity 18 of cooler chest 14, insulating pad 10 is pressed down against the perishables 22 and the cooling medium 16. Similarly, in FIG. 4, a cutaway cross sectional view of the cooler chest 14 depicts insulating pad 10 pressed against the interior wall 14B of cooler chest 14. These figures demonstrate the sealing properties of insulating pad 10 as it bulges slightly while conforming to the interior walls of the cooler cavity 18, creating compression seal 20.

As mentioned above, insulating pad 10 may comprise of an elastic closed cell foam, such as PVC/NBR, and trimmed slightly oversized when compared to the dimensions of the cooler cavity 18. The oversizing of insulating pad 10 causes its edges to compress and bulge as they contact and conform to the shape of the interior walls 14B of cooler chest 14, especially when a user presses the edges against a side to install insulating pad 10 within cooler chest 14. The bulging and subsequent rebounding of insulating pad 10 creates a compression seal 20 so as to seal perishables 22 and cooling medium 16 from outside heat. A consequence of the placement of insulating pad 10 is that the volume of the zone of air which would otherwise surround perishables 22 and cooling medium 16 is reduced. For example, and without limiting the scope of the present invention, insulating pad 10 is pressed against cooling medium 16 so as to minimize the air in lower portion 18A of the interior cavity 18; the compression seal 20—running along a perimetrical edge or boundary 17 between the sides, or planar edge walls 10B, of insulation pad 10 and interior walls 14B—prevents or minimizes a heat transfer from upper portion 18B of interior cavity 18.

From this view, it may be appreciated that, although the entire edge along a perimeter of the rectangular prism is pressed against the interior walls 14B of the cooler chest 14, insulating pad 10 does not bow significantly and rather maintains a substantially flat or planar top surface 10A along the entire surface of the interior cavity 18 (facing upper cavity 18A) and the edge (along boundary 17) conforms to the interior walls forming compression seal 20, which generally comprises: a first bulge 20A along a top surface of the edge of insulating pad 10, and a second bulge 20B along a bottom surface of the edge of insulating pad 10; the next figure better illustrates these characteristics of an exemplary compression seal 20.

Figure 5:
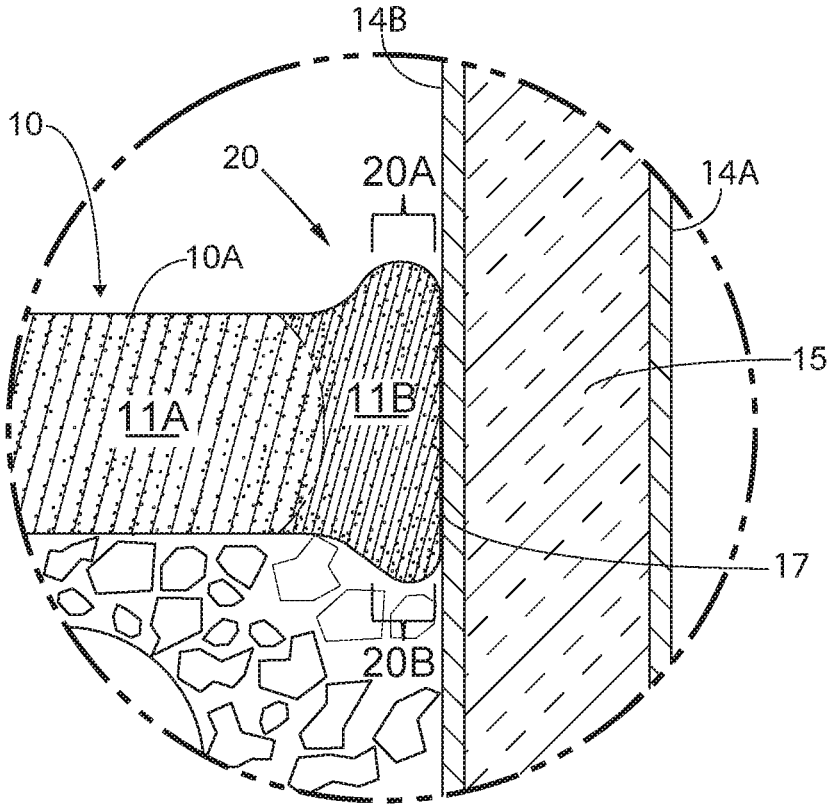
FIG. 5 illustrates a close-up view of a compression seal in accordance with exemplary practice of the present invention.

FIG. 5 illustrates a close-up view of a compression seal in accordance with exemplary practice of the present invention. More specifically, this view depicts cooler chest 14 configured for improved insulation of perishables 22 and cooling medium 16, comprising: a cover; an interior cavity 18 formed by interior walls 14B, the interior cavity 18 having an interior depth, length and width; and a flexible insulating pad 10 laying substantially planar along a surface of the interior cavity of the cooler chest 14.

Such insulating pad 10 may comprise of: a rectangular prism having a thickness T sufficient to allow compression without bowing the flexible insulating pad 10, the rectangular prism having a length L and a width W slightly greater than a length and a width of the interior cavity 18 of the cooler chest 14, and an edge or boundary 17 along a perimeter of the rectangular prism that is pressed against the interior walls 14B of the cooler chest 14 so that the flexible insulating pad 10 does not bow along the entire surface of the interior cavity and the edge or boundary 17 conforms to the interior walls 14B forming a compression seal 20, comprising: a first bulge 20A along a top surface of the edge or boundary 17 of the flexible insulating pad 10, and a second bulge 20B along a bottom surface of the edge or boundary 17 of the flexible insulating pad 10.

From this view, one of the advantages of using PVC/NBR may be appreciated. As mentioned above, a pad constructed of PVC/NBR facilitates the body of the device to compress such that a portion 11B near the edge or boundary 17 between insulating pad 10 and interior walls 14B bulges as the material presses up against the interior walls, while the remaining portion 11A remains sufficiently sturdy and does not collapse—thus, does not bow along the entire surface of the interior cavity. This characteristic is desirable because it improves the seal between lower cavity 18A and upper cavity 18B. This is an improvement over prior art devices that fold over or lay relatively loosely a top of perishables, which undesirably allow an easier heat transfer between cavities that may be separated by the prior art devices.

In practice, an exemplary method of insulating a portion of a cooler chest 14 packed with perishables 22 and cooling medium 16, may comprise of: (a) cutting a single sheet of a closed cell polyvinyl chloride nitrile butadiene rubber (PVC/NBR) foam to form a pad, wherein the pad comprises a thickness sufficient to allow compression without bowing the pad when pressed against interior walls of the cooler chest, the pad defined by a length and a width slightly greater than a length and a width of an interior cavity formed by the interior walls of the cooler chest; (b) placing the pad over the interior cavity and below a cover of the cooler chest to conceal the perishables and cooling medium; and (c) sealing the interior cavity of the cooler chest with a compression seal, including by: (c-1) pressing an edge along a perimeter of the pad against the interior walls of the cooler chest so that the edge conforms to the interior walls of the cooler chest, wherein the pad remains substantially planar or flat along an entire top surface of the pad in contact with the interior cavity of the cooler chest and the pad does not bow, and (c-2) forming a bulge on a top surface and a bottom surface of each edge of the pad pressed against the interior walls.

In exemplary embodiments, placing the pad over the interior cavity and below a cover of the cooler chest as in step (b) may comprise of step (b-1) separating the interior cavity of the cooler chest into a first cavity and a second cavity with the pad, wherein the perishables and cooling medium occupy the first cavity, and a space between the top surface of the pad and a bottom surface of the cover forms the second cavity.

It is to be understood that the present invention is not limited to the sole embodiment described above, but encompasses any and all embodiments within the scope of the following claims.

A cooler chest interior insulation device and method has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

What is claimed is:

1. A cooler chest configured for improved insulation of perishables and cooling medium, comprising:
- a cover;
- an interior cavity formed by interior walls, the interior cavity having an interior depth, length and width; and
- a flexible insulating pad laying substantially planar along an entire surface of the interior cavity of the cooler chest, comprising:
  - a rectangular prism having a planar top surface covering the entire surface of the interior cavity, a planar bottom surface, a thickness sufficient to allow compression without bowing the flexible insulating pad, and a length and a width slightly greater than a length and a width of the interior cavity of the cooler chest, and
  - a planar edge along a perimeter of the rectangular prism that is pressed against the interior walls of the cooler chest so that the flexible insulating pad does not bow along the entire surface of the interior cavity and the planar edge conforms to the interior walls forming a compression seal throughout an entire perimetrical boundary between the flexible insulating pad and the interior walls of the cooler chest, the compression seal comprising:
    - a first bulge along a top surface of the planar edge of the flexible insulating pad, and
    - a second bulge along a bottom surface of the planar edge of the flexible insulating pad.

2. The cooler chest of claim 1, wherein the flexible insulating pad is a sheet of closed cell polyvinyl chloride nitrile butadiene rubber (PVC/NBR) foam.

3. The cooler chest of claim 1, wherein the flexible insulating pad separates the interior cavity of the cooler chest into a first cavity and a second cavity, the perishables and cooling medium occupying the first cavity and a space between the top surface of the flexible insulating pad and a bottom surface of the cover forming the second cavity.

4. The cooler chest of claim 1, wherein the flexible insulating pad comprises a thickness of 0.75 inches.

5. The cooler chest of claim 1, wherein the dimensions of the flexible insulating pad comprises include:
- a length between 35 to 45 inches; and
- a width between 15 and 20 inches.

6. The cooler chest of claim 1, wherein the dimensions of the flexible insulating pad comprises include:
- a length between 20 to 30 inches; and
- a width between 10 and 15 inches.

7. The cooler chest of claim 1, wherein the cooling medium comprises one or more selected from the group of: crushed ice, cubed ice and a block of ice.

8. The cooler chest of claim 1, wherein the cooling medium comprises an ice pack.

9. The cooler chest of claim 1, wherein the cooling medium comprises a refrigerant gel.

10. The cooler chest of claim 1, wherein the perishables comprise one or more selected from the group of: food items; drinking products; and medical products.

11. A method of insulating a portion of a cooler chest packed with perishables and cooling medium, comprising:

cutting a single sheet of a closed cell polyvinyl chloride nitrile butadiene rubber (PVC/NBR) foam to form a pad, the pad comprising a planar top surface, a planar bottom surface and a thickness sufficient to allow compression without bowing the pad when pressed against interior walls of the cooler chest, the pad defined by a length and a width slightly greater than a length and a width of an interior cavity formed by the interior walls of the cooler chest;

placing the pad over the interior cavity and below a cover of the cooler chest to conceal the perishables and cooling medium; and sealing the interior cavity of the cooler chest with a compression seal throughout an entire perimetrical boundary between the pad and the interior walls of the cooler chest, including:

pressing a planar edge along a perimeter of the pad against the interior walls of the cooler chest so that the planar edge conforms to the interior walls of the cooler chest, wherein the pad remains substantially planar along an entire surface of the interior cavity of the cooler chest and the pad does not bow, and forming a bulge on a top surface and a bottom surface of the planar edge of the pad pressed against the interior walls.

12. The method of claim 11, wherein placing the pad over the interior cavity and below a cover of the cooler chest comprises: separating the interior cavity of the cooler chest into a first cavity and a second cavity with the pad, wherein the perishables and cooling medium occupy the first cavity and a space between the surface of the pad and a bottom surface of the cover forms the second cavity.

13. The method of claim 11, wherein cutting the single sheet of PVC/NBR foam to form a pad comprises cutting the single sheet to include a thickness of 0.75 inches.

14. The method of claim 11, wherein cutting the single sheet of PVC/NBR foam to form a pad comprises cutting the single sheet to include:

a length between 35 to 45 inches; and a width between 15 and 20 inches.

15. The method of claim 11, wherein cutting the single sheet of PVC/NBR foam to form a pad comprises cutting the single sheet to include:

a length between 20 to 30 inches; and a width between 10 and 15 inches.

16. A cooler chest configured for improved insulation of perishables and cooling medium, comprising:

an interior cavity formed by interior walls, the interior cavity having an interior depth, length and width; and a flexible insulating pad laying substantially planar along a surface of the interior cavity of the cooler chest, comprising:

a rectangular closed cell polyvinyl chloride nitrile butadiene rubber (PVC/NBR) foam having: planar top surface covering the entire surface of the interior cavity, a planar bottom surface, a thickness sufficient to allow compression without bowing the flexible insulating pad, and a length and a width slightly greater than a length and a width of the interior cavity of the cooler chest, and a planar edge along a perimeter of the flexible insulating pad that is pressed against the interior walls of the cooler chest so that the flexible insulating pad does not bow along the entire surface of the interior cavity and the edge conforms to the interior walls forming a compression seal throughout an entire perimetrical boundary between the flexible insulating pad and the interior walls of the cooler chest, the compression seal comprising:

a first bulge along a top surface of the planar edge of the flexible insulating pad, and a second bulge along a bottom surface of the planar edge of the flexible insulating pad, wherein the dimensions of the flexible insulating pad comprises include: a thickness of 0.75 inches; a length between 20 to 45 inches; and a width between 10 and 20 inches.

17. The cooler chest of claim 16, wherein the cooling medium comprises one or more selected from the group of: crushed ice, cubed ice and a block of ice.

18. The cooler chest of claim 16, wherein the cooling medium comprises an ice pack.

19. The cooler chest of claim 16, wherein the cooling medium comprises a refrigerant gel.

20. The cooler chest of claim 16, wherein the perishables comprise one or more selected from the group of: food items; drinking products; and medical products.

* * * * *